US010329895B2

(12) United States Patent
Chau et al.

(10) Patent No.: US 10,329,895 B2
(45) Date of Patent: Jun. 25, 2019

(54) ADVANCED DRILL STRING INGROUND ISOLATOR HOUSING IN AN MWD SYSTEM AND ASSOCIATED METHOD

(71) Applicant: Merlin Technology, Inc., Kent, WA (US)

(72) Inventors: Albert W. Chau, Woodinville, WA (US); Kenneth J. Theimer, Auburn, WA (US)

(73) Assignee: Merlin Technology Inc., Kent, WA (US)

( * ) Notice: Subject to any disclaimer, the term of this patent is extended or adjusted under 35 U.S.C. 154(b) by 193 days.

(21) Appl. No.: 15/231,750

(22) Filed: Aug. 8, 2016

(65) Prior Publication Data

US 2016/0348495 A1 Dec. 1, 2016

Related U.S. Application Data

(62) Division of application No. 13/827,945, filed on Mar. 14, 2013, now Pat. No. 9,422,802.

(51) Int. Cl.
*E21B 47/01* (2012.01)
*E21B 17/00* (2006.01)
(Continued)

(52) U.S. Cl.
CPC ..... *E21B 47/01* (2013.01); *E21B 17/003* (2013.01); *E21B 47/011* (2013.01); *E21B 47/024* (2013.01); *E21B 7/046* (2013.01)

(58) Field of Classification Search
CPC ..... E21B 47/01; E21B 47/011; E21B 17/003; E21B 17/023; E21B 47/024
See application file for complete search history.

(56) References Cited

U.S. PATENT DOCUMENTS 2,354,887 A 8/1944 Silverman et al.
4,348,672 A 9/1982 Givler
(Continued)

FOREIGN PATENT DOCUMENTS

CA 2778434 A1 4/2011
GB 2076039 A 11/1981
(Continued)

OTHER PUBLICATIONS

Extended European Search Report for European Application No. 12748918.5 which is associated with International Application No. PCT/US2012/024257 which is associated with U.S. Appl. No. 13/035,774, dated Oct. 24, 2017, Munich, Germany.
(Continued)

*Primary Examiner* — Giovanna C Wright
(74) *Attorney, Agent, or Firm* — Pritzkau Patent Group, LLC

(57) ABSTRACT

A housing defines a through passage along its length and is configured to support a group of electrical isolators surrounding the through passage to form an electrically isolating break in a drill string such that each isolator of the group of isolators is subject to no more than a compressive force responsive to extension and retraction of the drill string. The housing defines a housing cavity to receive an electronics package having a signal port and is configured for electrical connection of the signal port across the electrically isolating break. A housing lid can cooperate with a main housing body to define elongated slots for purposes of enhancing the emanation of a locating signal. A housing arrangement can support electrical connections from an electronics package to bridge an electrically isolating gap.

5 Claims, 9 Drawing Sheets

(51) Int. Cl.
*E21B 47/024* (2006.01)
*E21B 7/04* (2006.01)

(56) References Cited

U.S. PATENT DOCUMENTS

| | | | | |
|---|---|---|---|---|
| 4,496,203 | A | 1/1985 | Meadows | |
| 4,578,675 | A | 3/1986 | MacLeod | |
| 4,605,268 | A | 8/1986 | Meador | |
| 4,864,293 | A | 9/1989 | Chau | |
| 4,928,760 | A | 5/1990 | Freitas | |
| 5,138,313 | A | 8/1992 | Barrington | |
| 5,159,978 | A | 11/1992 | Tomek et al. | |
| 5,251,708 | A | 10/1993 | Perry et al. | |
| 5,816,344 | A | 10/1998 | Turner | |
| 5,869,968 | A | 2/1999 | Brooks et al. | |
| 5,961,252 | A | 10/1999 | Mercer et al. | |
| 6,035,951 | A | 3/2000 | Mercer et al. | |
| 6,100,696 | A | 8/2000 | Sinclair | |
| 6,134,892 | A | 10/2000 | Turner et al. | |
| 6,367,564 | B1 | 4/2002 | Mills et al. | |
| 6,389,360 | B1 | 5/2002 | Alft et al. | |
| 6,404,350 | B1 | 6/2002 | Soulier | |
| 6,445,307 | B1 | 9/2002 | Rassi et al. | |
| 6,484,818 | B2 | 11/2002 | Alft et al. | |
| 6,487,901 | B1 * | 12/2002 | Keyes | E21B 47/01 73/152.46 |
| 6,496,008 | B1 | 12/2002 | Brune et al. | |
| 6,581,680 | B1 | 6/2003 | Wentworth | |
| 6,866,306 | B2 | 3/2005 | Boyle et al. | |
| 6,899,178 | B2 | 5/2005 | Tubel | |
| 7,012,432 | B2 | 3/2006 | Allan | |
| 7,064,676 | B2 | 6/2006 | Hall et al. | |
| 7,150,329 | B2 | 12/2006 | Chau | |
| 7,170,423 | B2 | 1/2007 | Wisler et al. | |
| 7,362,235 | B1 | 4/2008 | Normann | |
| 7,490,428 | B2 | 2/2009 | Morys | |
| 7,525,315 | B2 | 4/2009 | Fredette et al. | |
| 7,649,474 | B1 | 1/2010 | Gard | |
| 7,775,301 | B2 | 8/2010 | Brune et al. | |
| 7,777,644 | B2 | 8/2010 | Madhavan et al. | |
| 8,695,727 | B2 | 4/2014 | Chau et al. | |
| 9,000,940 | B2 | 4/2015 | Chau | |
| 2002/0014334 | A1 | 2/2002 | Chau | |
| 2003/0192692 | A1 | 10/2003 | Tubel | |
| 2004/0075577 | A1 | 4/2004 | Allan | |
| 2005/0087368 | A1 | 4/2005 | Boyle | |
| 2005/0150713 | A1 * | 7/2005 | Garcia-Osuna | E21B 47/01 181/108 |
| 2005/0218898 | A1 | 10/2005 | Fredette et al. | |
| 2007/0023185 | A1 | 2/2007 | Hall et al. | |
| 2007/0029112 | A1 | 2/2007 | Li et al. | |
| 2010/0224356 | A1 | 9/2010 | Moore | |
| 2011/0311305 | A1 | 12/2011 | Cairo et al. | |
| 2012/0085583 | A1 | 4/2012 | Logan | |
| 2012/0217023 | A1 | 8/2012 | Chau et al. | |
| 2012/0218863 | A1 | 8/2012 | Chau et al. | |
| 2013/0043874 | A1 | 2/2013 | Clark et al. | |
| 2013/0176139 | A1 | 7/2013 | Chau et al. | |
| 2014/0055278 | A1 | 2/2014 | Chau et al. | |
| 2014/0174825 | A1 | 6/2014 | Chau et al. | |

FOREIGN PATENT DOCUMENTS

| | | | |
|---|---|---|---|
| GB | 2405420 | A | 3/2005 |
| GB | 2427218 | A | 12/2006 |
| RU | 27839 | U1 | 2/2003 |
| RU | 2232888 | | 7/2004 |
| RU | 47970 | U1 | 9/2005 |
| RU | 65133 | U1 | 7/2007 |
| RU | 2351759 | C1 | 4/2009 |
| WO | 82/02754 | | 8/1982 |
| WO | 84/01439 | A1 | 4/1984 |
| WO | 99/08035 | | 2/1999 |
| WO | 2009/086637 | A1 | 7/2009 |
| WO | 2011/049573 | A1 | 4/2011 |
| WO | 2014/031663 | A1 | 2/2014 |

OTHER PUBLICATIONS

First Office Action for Chinese Application No. 201480015049.2, which is associated with International Application No. PCT/US2014/022861 which is associated with U.S. Appl. No. 13/827,945, dated Oct. 23, 2017. (Machine translation included).

Third Office Action for Chinese Application No. 201280015145.8, which is associated with International Application No. PCT/US2012/024257 which is associated with U.S. Appl. No. 13/035,774, dated Jan. 4, 2017. (Machine translation included).

Fourth Office Action for Chinese Application No. 201280015145.8, which is associated with International Application No. PCT/US2012/024257 which is associated with U.S. Appl. No. 13/035,774, dated Jul. 5, 2017. (Machine translation included).

First Office Action for Chinese Application No. 201380044134.7, which is associated with International Application No. PCT/US2013/055828 which is associated with U.S. Appl. No. 13/593,439, dated Apr. 24, 2017. (Machine translation included).

First Office Action of the Russian Federation for Russian Application No. 2015138903 which is associated with International Application No. PCT/US2014/022861 which is associated with U.S. Appl. No. 13/827,945, dated May 12, 2017.

Fifth Office Action for Chinese Application No. 201280015145.8, which is associated with International Application No. PCT/US2012/024257 which is associated with U.S. Appl. No. 13/035,774, dated Mar. 5, 2018. (Machine translation included).

Second Office Action for Chinese Application No. 201380044134.7, which is associated with International Application No. PCT/US2013/055828 which is associated with U.S. Appl. No. 13/593,439, dated Mar. 14, 2018. (Machine translation included).

Extended European Search Report for European Application No. 14773317.4 which is associated with International Application No. PCT/US2014/022861 which is associated with U.S. Appl. No. 13/827,945, dated Oct. 7, 2016, Munich, Germany.

The International Search Report and the Written Opinion of the International Searching Authority for International Application No. PCT/2014/022861 which is associated with U.S. Appl. No. 13/827,945, dated Jul. 10, 2014, Moscow, Russia.

The International Search Report and the Written Opinion of the International Searching Authority for International Application No. PCT/US 12/24257 which is associated with U.S. Appl. No. 13/035,774, dated May 17, 2012, Alexandria, Virginia.

The International Search Report and the Written Opinion of the International Searching Authority for International Application No. PCT/US2012/024261 which is associated with U.S. Appl. No. 13/035,833, dated Jun. 12, 2012, Alexandria, Virginia.

The International Search Report and the Written Opinion of the International Searching Authority for International Application No. PCT/US2013/055828 which is associated with U.S. Appl. No. 13/593,439, dated Dec. 5, 2013, Moscow, Russia.

International Preliminary Report on Patentability for International Application No. PCT/2014/022861 which is associated with U.S. Appl. No. 13/827,945, dated Feb. 24, 2015, Alexandria, Virginia.

Office Action for Chinese Application No. 201280015241.2, which is associated with International Application No. PCT/US2012/024261 which is associated with U.S. Appl. No. 13/035,833, dated Aug. 25, 2015. (Copy of machine translation also included).

Office Action for Chinese Application No. 201280015145.8, which is associated with International Application No. PCT/US2012/024257 which is associated with U.S. Appl. No. 13/035,774, dated Aug. 4, 2015. (Copy of machine translation also included).

Applicant's Instructions to Foreign Associate for Response to 1st Office Action for Chinese Application No. 201280015241.2, which is associated with International Application No. PCT/US2012/024261 which is associated with U.S. Appl. No. 13/035,833, dated Feb. 14, 2016.

Applicant's Instructions to Foreign Associate for Response to 1st Office Action for Chinese Application No. 201280015145.8, which

(56) References Cited

OTHER PUBLICATIONS is associated with International Application No. PCT/US2012/024257 which is associated with U.S. Appl. No. 13/035,774, dated Feb. 17, 2016.
Second Office Action for Chinese Application No. 201280015145.8, which is associated with International Application No. PCT/US2012/024257 which is associated with U.S. Appl. No. 13/035,774, dated Jun. 3, 2016.
Second Office Action for Chinese Application No. 201280015241.2, which is associated with International Application No. PCT/US2012/024261 which is associated with U.S. Appl. No. 13/035,833, dated Jun. 3, 2016. (Copy of machine translation also included).
Extended European Search Report for European Application No. 13830793.9 which is associated with International Application No. PCT/US2013/055828 which is associated with U.S. Appl. No. 13/593,4329, dated Jul. 7, 2016, Munich, Germany.
eSpacenet machine translation of previously cited RU27839U1, Dec. 11, 2006, Russia.
eSpacenet machine translation of previously cited RU65133U1, Jul. 27, 2007, Russia.
First Office Action for Russian Application No. 2015138903/03, which is associated with International Application No. PCT/US2014/022861, which is associated with U.S. Appl. No. 15/231,750 (Machine Translation Included).
Second Office Action for Chinese Application No. 201480015049.2, which is associated with International Application No. PCT/US2014/022861 which is associated with U.S. Appl. No. 13/827,945, dated Oct. 23, 2017. (Machine translation included).
Google machine translation of previously cited RU27839U1, Dec. 11, 2006, Russia.
Google machine translation of previously cited RU65133U1, Jul. 27, 2007, Russia.
Prosecution History of U.S. Appl. No. 13/035,833, filed Feb. 25, 2011, now abandoned.
Prosecution History of U.S. Appl. No. 14/193,280, filed Feb. 28, 2014 and now issued as U.S. Pat. No. 9,617,797.
Prosecution History of U.S. Appl. No. 14/629,269, filed Feb. 23, 2015 and now issued as U.S. Pat. No. 9,500,041.
Prosecution History of U.S. Appl. No. 15/336,668, filed Oct. 27, 2016 and now issued as U.S. Pat. No. 9,932,777.
Global dossier translation of the concurrently cited Second Office Action for Chinese Application No. 201480015049.2, which is associated with International Application No. PCT/US2014/022861 which is associated with U.S. Appl. No. 13/827,945, dated Oct. 23, 2017.

* cited by examiner

ADVANCED DRILL STRING INGROUND ISOLATOR HOUSING IN AN MWD SYSTEM AND ASSOCIATED METHOD

RELATED APPLICATION

This application is a divisional application of copending U.S. patent application Ser. No. 13/827,945 filed on Mar. 14, 2013, the disclosure of which is incorporated herein by reference.

BACKGROUND

The present application is generally related to inground operations and, more particularly, to an apparatus and method for electrically coupling an electrical signal onto an electrically conductive drill string for purposes of transferring the signal.

Generally, an inground operation such as, for example, drilling to form a borehole, subsequent reaming of a borehole for purposes of installing a utility line, borehole mapping and the like use an electrically conductive drill string which extends from an above ground drill rig. The prior art includes examples of the use of an electrically conductive drill string as an electrical conductor for serving to electrically conduct a data signal from an inground tool to the drill rig. The surrounding earth itself serves as a signal return path for purposes of detecting the signal at the drill rig. This type of system is often referred to as a Measurement While Drilling, MWD, system.

An example of an attempt to use the drill string as an electrical conductor in an MWD system is seen, for example, in U.S. Pat. No. 4,864,293 (hereinafter, the '293 patent). In one embodiment, the patent teaches an electrically isolated collar that is fitted around the drill string. Applicants recognize that the use of such an electrically isolated collar (FIG. 2, item 32) is problematic at least with respect to durability in what can be an extremely hostile inground environment. In another embodiment, shown in FIGS. 3 and 4, a suitable dielectric separator 40 is diagrammatically shown and asserted to electrically isolate a front section of the drill string from the remainder of the drill string. No detail is provided that would reasonably teach one how to fabricate this separator, but it is reasonable to assume that the isolator would simply be inserted into a break in the drill string for co-rotation therewith. Unfortunately, the isolator would then be subject to the same rigorous mechanical stresses during the drilling operation as the drill pipe sections of the drill string including pure tension force during pullback operations and high shear forces due to rotational torque that is applied to the drill string by the drill rig. While the drill string is generally formed from high strength steel that can readily endure these forces, Applicants are unaware of any currently available non electrically conductive material that is capable of enduring all these different forces with a reliability that Applicants consider as acceptable. It should be appreciated that the consequences of breaking off the end of the drill string during a drilling operation are extremely severe. Thus, the risk introduced through the use of an isolator in the suggested manner is submitted to be unacceptable.

An even earlier approach is seen in U.S. Pat. No. 4,348,672 in which an attempt is made to introduce an electrically isolating break in the drill string using various layers of dielectric material that are interposed between the components of what the patent refers to as an "insulated gap sub assembly" that is made up of first and second annular sub members. One embodiment is illustrated by FIGS. 5 and 6 while another embodiment is illustrated by FIGS. 7 and 8 of the patent. Unfortunately, the practice of interposing relatively thin dielectric layers in a gap defined between adjacent high-strength metal components, that are competent to withstand extreme forces as well as a hostile downhole environment, is unlikely to provide an acceptable level of performance. In particular, these dielectric layers are subjected to the same severe forces as the first and second annular sub members such that durability in a hostile downhole environment is most likely to be limited. That is, the desired electrical isolation will be compromised at the moment that one of the relatively thin dielectric layers is worn through.

Practical approaches with respect to coupling an electrical signal onto a drill string in the context of an MWD system are seen, for example, in U.S. patent application Ser. No. 13/035,774 (hereinafter the '774 application), U.S. patent application Ser. No. 13/035,833 (hereinafter, the '833 application) and U.S. patent application Ser. No. 13/593,439 (hereinafter, the '439 application), each of which is commonly owned with the present application and each of which is incorporated herein by reference in its entirety. While the '774, '833 and '439 applications provided sweeping advantages over the then-existing state of the art, Applicants have discovered yet another other highly advantageous approach, as will be described hereinafter.

The foregoing examples of the related art and limitations related therewith are intended to be illustrative and not exclusive. Other limitations of the related art will become apparent to those of skill in the art upon a reading of the specification and a study of the drawings.

SUMMARY

The following embodiments and aspects thereof are described and illustrated in conjunction with systems, tools and methods which are meant to be exemplary and illustrative, not limiting in scope. In various embodiments, one or more of the above-described problems have been reduced or eliminated, while other embodiments are directed to other improvements.

In general, an apparatus and associated method are disclosed for use in combination with a drill string that is electrically conductive and extends from an inground distal end, that includes an inground tool, to a drill rig. In one aspect of the disclosure, a housing defines a through passage along a length thereof and the housing is configured to support a group of electrical isolators surrounding the through passage to form an electrically isolating break in the drill string such that, responsive to the drill rig pushing on the drill string and responsive to the drill rig pulling on the drill string, each isolator of the group of isolators is subject to no more than a compressive force. The housing defines a housing cavity to receive an electronics package having a signal port and configured for electrical connection of the signal port across the electrically isolating break.

In another aspect of the present disclosure, a housing arrangement and associated method are disclosed for use as part of an inground tool for receiving a transmitter to transmit a locating signal from the inground tool. A main housing supports the transmitter in an operating position while emanating the locating signal. A lid is configured for removable installation on the housing such that at least a portion of the main housing and a portion of the lid are disposed in a confronting relationship to cooperatively define at least one elongated slot leading from an exterior of the housing arrangement to the transmitter.

In still another aspect of the present disclosure, a housing and associated method are described for use as part of an inground tool for supporting an electronics package having an output cable for carrying an output signal. A housing body is electrically conductive and defines a cavity for receiving the electronics package such that the electronics package forms a first electrical connection to the housing body. An intermediate housing is electrically conductive and is receivable on one end of the housing body to cooperate with the housing body in a way that forms an electrical isolation gap between the intermediate housing and the housing body while supporting the cable so as to extend across the gap for electrical connection to the intermediate housing such that the electronics package is electrically bridged across the gap.

BRIEF DESCRIPTIONS OF THE DRAWINGS

Exemplary embodiments are illustrated in referenced figures of the drawings. It is intended that the embodiments and figures disclosed herein are to be illustrative rather than limiting.

Figure 9:
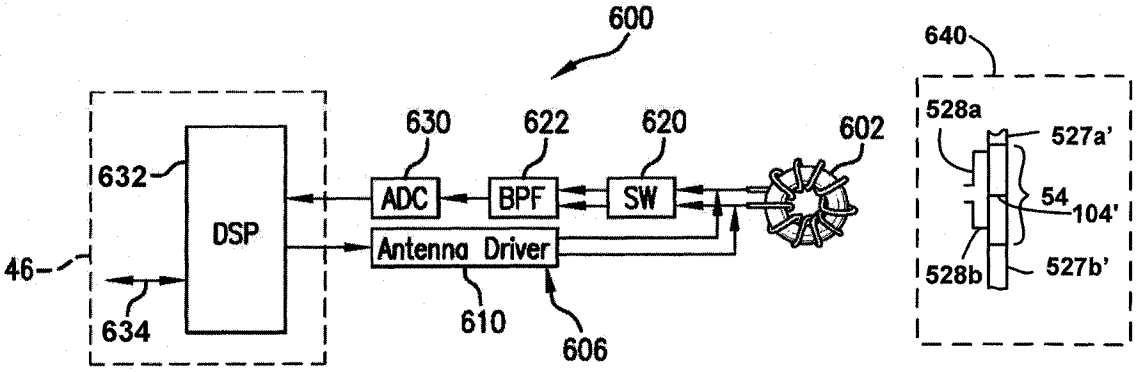

FIG. 9 is a block diagram of an embodiment of an uphole electronics section that is suitable for use at the drill rig for bidirectional communication with a downhole electronics section via the inground isolator housing of the present disclosure and further including an inset view which illustrates a repeater embodiment and associated electrical connections which transform the electronics section for downhole repeater use.

Figure 10:
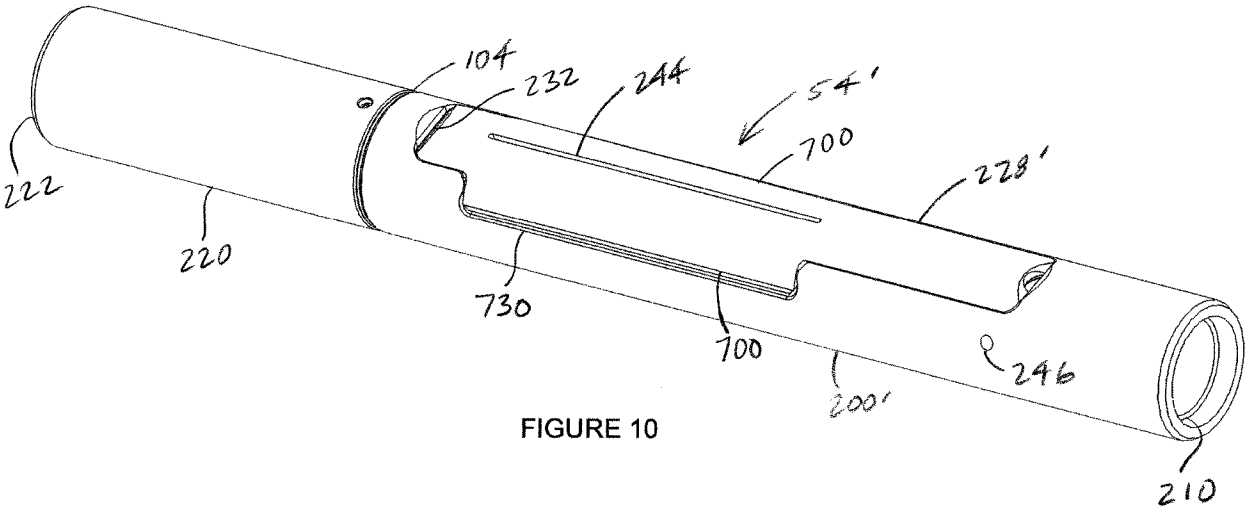

FIG. 10 is a diagrammatic view, in perspective, which illustrates another embodiment of the inground housing of the present disclosure in an assembled form.

Figure 11:
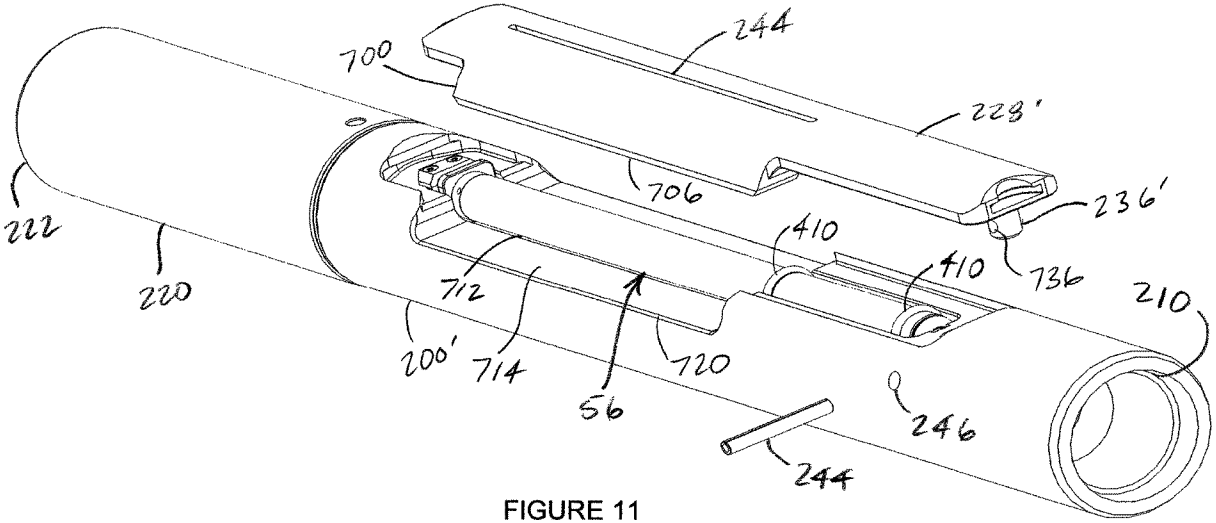

FIG. 11 is a diagrammatic partially exploded view, in perspective, showing further details of the embodiment of the inground housing of FIG. 10.

Figure 12:
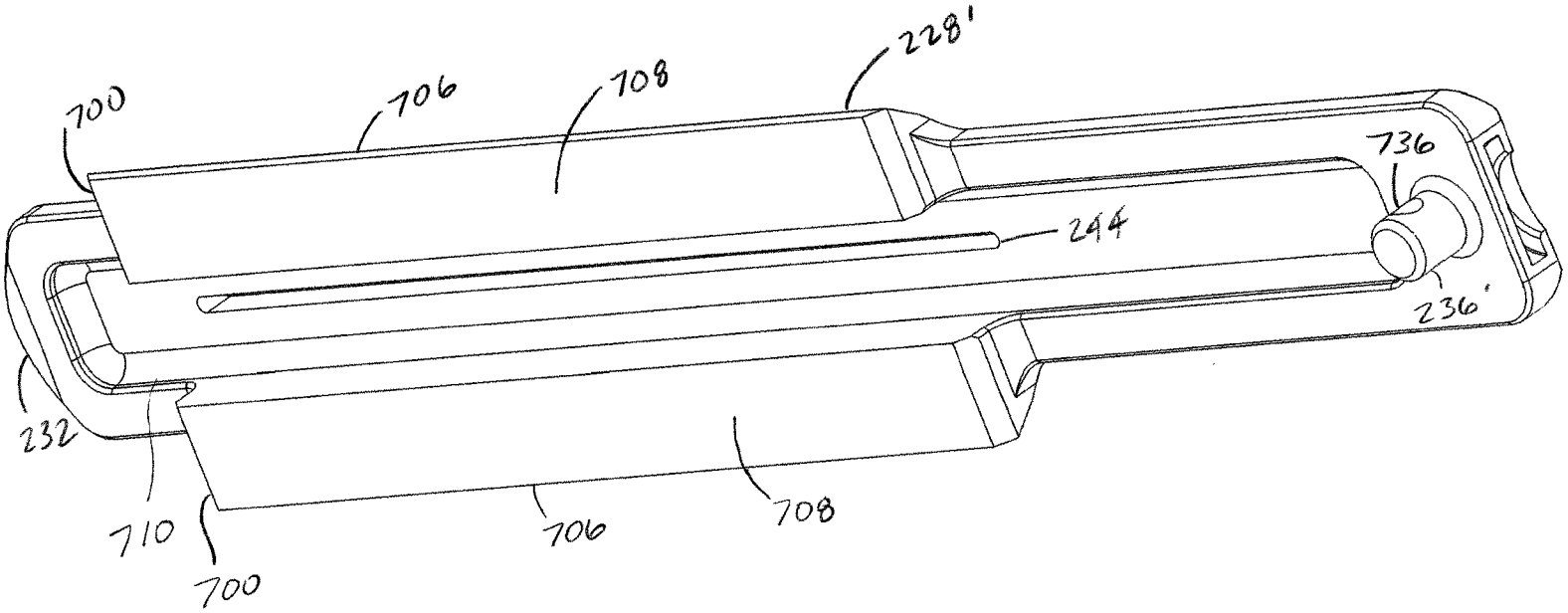

FIG. 12 is a diagrammatic bottom view, in perspective, showing details of a lid which forms part of the embodiment of FIG. 11.

DETAILED DESCRIPTION

The following description is presented to enable one of ordinary skill in the art to make and use the invention and is provided in the context of a patent application and its requirements. Various modifications to the described embodiments will be readily apparent to those skilled in the art and the generic principles taught herein may be applied to other embodiments. Thus, the present invention is not intended to be limited to the embodiments shown, but is to be accorded the widest scope consistent with the principles and features described herein including modifications and equivalents, as defined within the scope of the appended claims. It is noted that the drawings are not to scale and are diagrammatic in nature in a way that is thought to best illustrate features of interest. Descriptive terminology may be used with respect to these descriptions, however, this terminology has been adopted with the intent of facilitating the reader's understanding and is not intended as being limiting.

Figure 1:
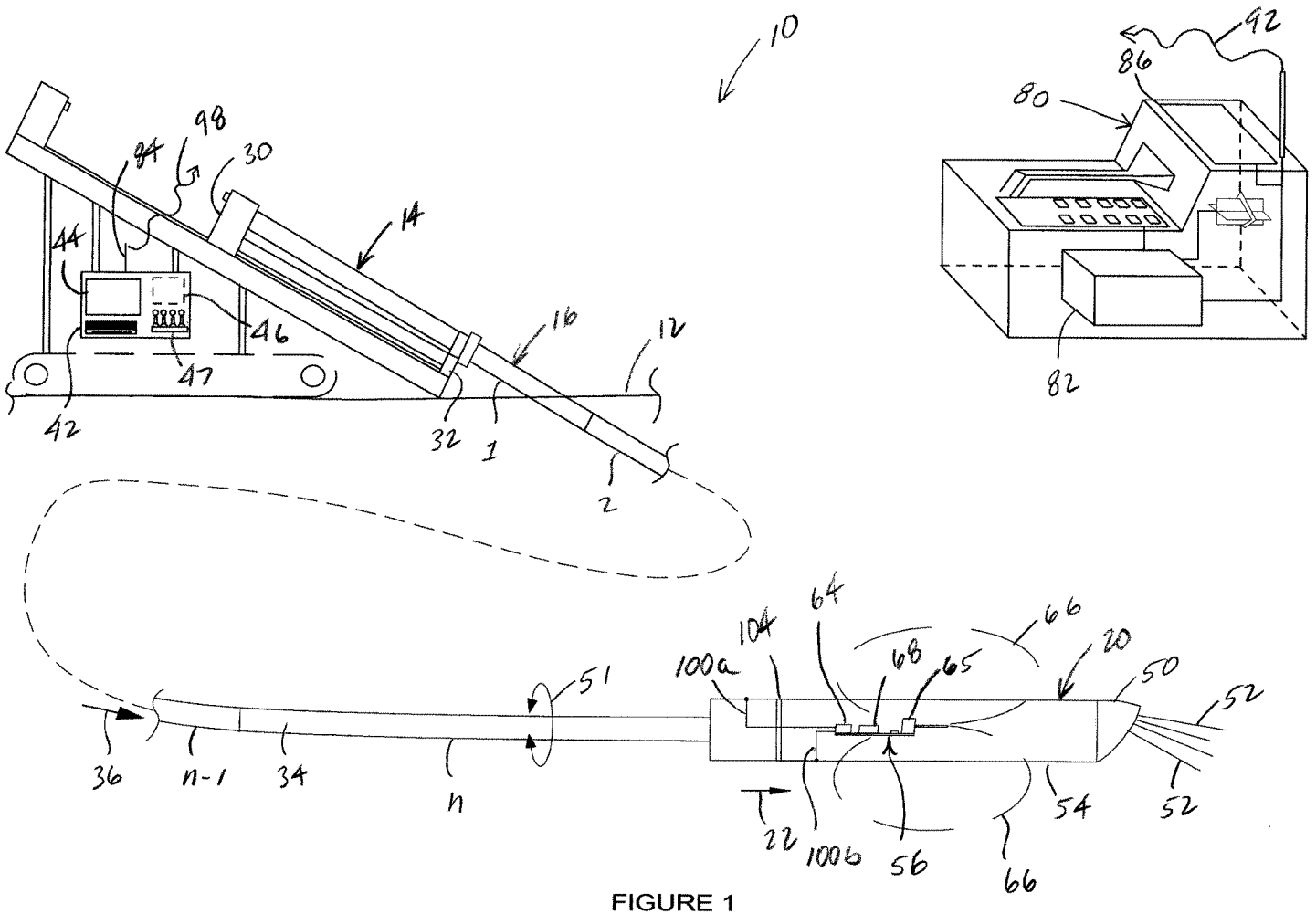
FIG. 1 is a diagrammatic view, in elevation, of a system which utilizes an embodiment of an inground isolator housing and associated method of the present disclosure.

Turning now to the figures wherein like components are indicated by like reference numbers throughout the various figures, attention is immediately directed to FIG. 1 which is an elevational view that diagrammatically illustrates an embodiment of a horizontal directional drilling system generally indicated by the reference number 10 and produced in accordance with the present disclosure. While the illustrated system shows the invention within the framework of a horizontal directional drilling system and its components for performing an inground boring operation, the invention enjoys equal applicability with respect to other operational procedures including, but not limited to vertical drilling operations, pullback operations for installing utilities, mapping operations and the like.

FIG. 1 illustrates system 10 operating in a region 12. System 10 includes a drill rig 14 having a drill string 16 extending therefrom to an inground tool 20. The drill string can be pushed into the ground to move inground tool 20 at least generally in a forward direction 22 indicated by an arrow. While the present example is framed in terms of the use of a boring tool which is diagrammatically shown as the inground tool and may be referred to as such, it should be appreciated that the discussions apply to any suitable form of inground tool including but not limited to a reaming tool, a tension monitoring tool for use during a pullback operation in which a utility or casing can be installed, a mapping tool for use in mapping the path of the borehole, for example, using an inertial guidance unit and downhole pressure monitoring. Further, the teachings herein can be utilized by an isolation sub or inground housing that can be inserted at any desired joint in the drill string including immediately behind the inground tool at the inground distal end of the drill string. In the operation of a boring tool, it is generally desirable to monitor based on the advance of the drill string whereas in other operations such as a pullback operation, monitoring can be performed responsive to retraction of the drill string.

With continuing reference to FIG. 1, drill string 16 is partially shown and is segmented, being made up of a plurality of removably attachable, individual drill pipe sections some of which are indicated as 1, 2, n−1 and n, having a section or segment length and a wall thickness. The drill pipe sections may be referred to interchangeably as drill rods having a rod length. During operation of the drill rig, one drill pipe section at a time can be added to the drill string and pushed into the ground by the drill rig using a movable carriage 30 in order to advance the inground tool. Drill rig 14 can include a suitable monitoring arrangement 32 for measuring movement of the drill string into the ground such as is described, for example, in U.S. Pat. No. 6,035,951 (hereinafter the '951 patent), entitled SYSTEMS, ARRANGEMENTS AND ASSOCIATED METHODS FOR TRACKING AND/OR GUIDING AN UNDERGROUND BORING TOOL, which is commonly owned with the present application and incorporated herein by reference.

Each drill pipe section defines a through opening 34 (one of which is indicated) extending between opposing ends of the pipe section. The drill pipe sections can be fitted with what are commonly referred to as box and pin fittings such that each end of a given drill pipe section can threadingly engage an adjacent end of another drill pipe section in the drill string in a well-known manner. Once the drill pipe sections are engaged to make up the drill string, the through openings of adjacent ones of the drill pipe sections align to form an overall pathway 36 that is indicated by an arrow. Pathway 36 can provide for a pressurized flow of drilling fluid or mud, consistent with the direction of the arrow, from the drill rig to the drill head or other inground tool, as will be further described.

The location of the boring tool within region 12 as well as the underground path followed by the boring tool may be established and displayed at drill rig 14, for example, on a console 42 using a display 44. The console can include a processing arrangement 46 and a control actuator arrangement 47. In some embodiments, control and monitoring of operational parameters can be automated.

Boring tool 20 can include a drill head 50 having an angled face for use in steering based on roll orientation. That is, the drill head when pushed ahead without rotation will generally be deflected on the basis of the roll orientation of its angled face. On the other hand, the drill head can generally be caused to travel in a straight line by rotating the drill string as it is pushed, as indicated by a double-headed arrow 51. Of course, predictable steering is premised upon suitable soil conditions. It is noted that the aforementioned drilling fluid can be emitted as jets 52 under high pressure for purposes of cutting through the ground immediately in front of the drill head as well as providing for cooling and lubrication of the drill head. Boring tool 20 includes an inground housing 54 that receives an electronics package 56. The inground housing is configured to provide for the flow of drilling fluid to drill head 50 around the electronics package. For example, the electronics package can include a cylindrical housing configuration that is supported in a centered manner within housing 54. Drill head 50 can include a pin fitting that is received in a box fitting of inground housing 54. An opposing end of the inground housing can include a box fitting that receives a pin fitting of an inground, distal end of drill string 16. For purposes of the discussions herein and the appended claims, the boring tool can be considered as part of the drill string so as to define a distal, inground end of the drill string. It is noted that the box and pin fittings of the drill head and the inground housing can be the same box and pin fittings as those found on the drill pipe sections of the drill string for facilitating removable attachment of the drill pipe sections to one another in forming the drill string. Of course, the fittings on the ends of the inground housing can readily be changed to suit particular needs. Inground electronics package 56 can include a drill string transceiver 64 and a locating transceiver 65. Further details with respect to the drill string transceiver will be provided at appropriate points hereinafter. Locating transceiver 65, in some embodiments, can transmit a ground penetrating signal 66 such as, for example, a dipole locating signal and can receive an electromagnetic signal that is generated by other inground components as will be described at an appropriate point below. In other embodiments, transceiver 65 can be replaced by a transmitter or may not be needed. In still other embodiments, transceiver 65 can be configured to receive a magnetic locating signal that is transmitted from aboveground using magnetometers for purposes of sensing the magnetic field, as will be further described. The present example assumes that electromagnetic signal 66 is a locating signal in the form of a dipole signal for descriptive purposes. Accordingly, electromagnetic signal 66 may be referred to as a locating signal. It should be appreciated that the electromagnetic locating signal can be modulated like any other electromagnetic signal and that the modulation data is thereafter recoverable from the signal. The locating functionality of the signal can depend, at least in part, on the characteristic shape of the flux field and its signal strength rather than its ability to carry modulation. Thus, modulation is not required. Information regarding certain parameters of the boring tool such as, for example, pitch and roll (orientation parameters), temperature, drilling fluid pressure and annular pressure surrounding the boring tool can be measured by a suitable sensor arrangement 68 located within the boring tool which may include, for example, a pitch sensor, a roll sensor, a temperature sensor, an AC field sensor for sensing proximity of 50/60 Hz utility lines and any other sensors that are desired such as, for example, a DC magnetic field sensor for sensing yaw orientation (a tri-axial magnetometer and/or a magnetic locating signal, with a three axis accelerometer to form an electronic compass in cooperation with the magnetometer to measure yaw orientation) and one or more pressure sensors. Drill string transceiver 64 can include a processor that is interfaced as necessary with sensor arrangement 68 and locating transceiver 65. In some embodiments, one or more accelerometers can be used to measure orientation parameters such as pitch and roll orientation. A battery (not shown) can be provided within the housing for providing electrical power.

A portable locator 80 can be used to detect electromagnetic signal 66. One suitable and highly advanced portable locater is described in U.S. Pat. No. 6,496,008, entitled FLUX PLANE LOCATING IN AN UNDERGROUND DRILLING SYSTEM, which is commonly owned with the present application and is incorporated herein by reference in its entirety. As mentioned above, the present descriptions apply to a variety of inground operations and are not intended as being limiting, although the framework of horizontal directional drilling has been employed for descriptive purposes. As discussed above, electromagnetic signal 66 can carry information including orientation parameters such as, for example, pitch and roll. Other information can also be carried by the electromagnetic signal. Such information can include, by way of example, parameters that can be measured proximate to or internal to the boring tool including temperatures, pressures and voltages such as a battery or power supply voltage. Locator 80 includes an electronics package 82. It is noted that the electronics package is interfaced for electrical communication with the various components of the locator and can perform data processing. Information of interest can be modulated on electromagnetic signal 66 in any suitable manner and transmitted to locator 80 and/or an antenna 84 at the drill rig, although this is not required. Any suitable form of modulation may be used either currently available or yet to be developed. Examples of currently available and suitable types of modulation include amplitude modulation, frequency modulation, phase modulation and variants thereof. Any parameter of interest in relation to drilling such as, for example, pitch may be displayed on display 44 and/or on a display 86 of locator 80 as recovered from the locating signal. Locator 80 can transmit a telemetry signal 92. Drill rig 14 can transmit a telemetry signal 98 that can be received by locator 80. The telemetry components provide for bidirectional signaling between the drill rig and locator 80. As one example of such signaling, based on status provided by drill rig monitoring unit 32, the drill rig can transmit an indication that the drill string is in a stationary state because a drill pipe section is being added to or removed from the drill string.

Still referring to FIG. 1, electrical connections 100*a* and 100*b* can extend from inground electronics package 56, as will be further described. Via these electrical connections, any sensed value or parameter relating to the operation of the inground tool can be electrically transmitted from the electronics package. One of ordinary skill in the art will appreciate that what is commonly referred to as a "wire-in-pipe" can be used to bidirectionally transfer signals between the drill rig and inground tool wherein one of the electrical connections comprises an insulated electrical conductor that extends up interior passageway 36 of the drill string to the drill rig and the other electrical connection is made directly to the electrically conductive drill string. The term wire-in-pipe refers to such an electrical conductor that is generally housed within the interior passageway. In accordance with the present disclosure, however, electrical connections 100*a* and 100*b* are formed so as to bridge an electrically isolating gap 104 that is formed by housing 54, as will be further described. It is noted that these electrical connections may be referred to collectively as a signal port that is associated with the electronics package. In various embodiments, the signal port can be configured for unidirectional or bidirectional communication.

Figure 2:
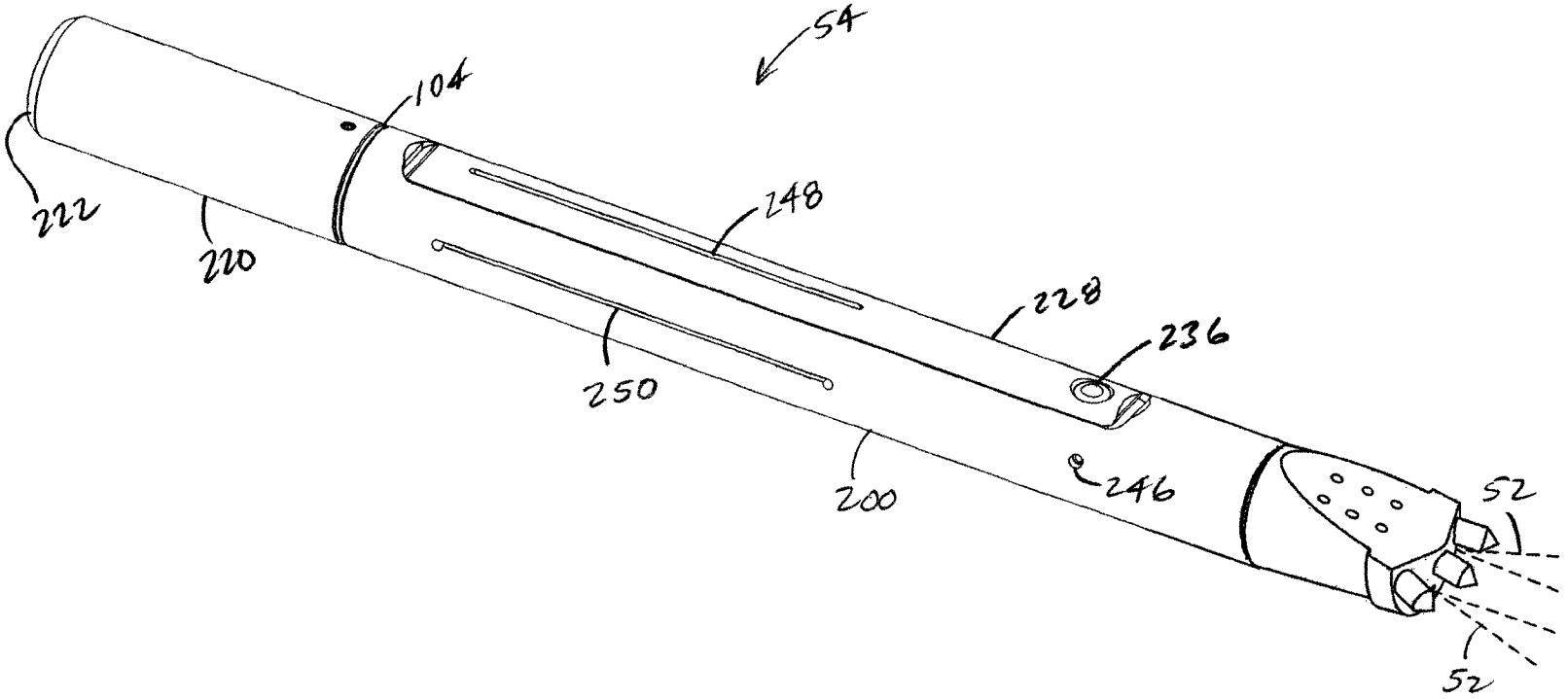
FIG. 2 is a diagrammatic view, in perspective, which illustrates an embodiment of the inground housing of the present disclosure in an assembled form.

Attention is now directed to FIG. 2 in conjunction with FIG. 1. FIG. 2 is a diagrammatic perspective view which illustrates an embodiment of housing 54 in its assembled form. The assembly includes a main housing 200 that can have a box fitting 210 which receives drill head 50. An intermediate housing 220 can define a box fitting 222. As discussed above, these fittings can match the opposing fittings on drill pipe sections that make up drill string 16 such that inground housing 54 can be inserted in any desired joint in the drill string. The inground housing provides electrically isolating break 104 between main housing 200 and intermediate housing 220. In some embodiments, a mud motor can be attached to housing 54. In such an embodiment, an opposing side of the mud motor can support a bend sub which itself supports the drill head. The mud motor can rotate the bend sub and drill head in a well-known manner responsive to drilling fluid pressure without the need to rotate the drill string.

Figure 3:
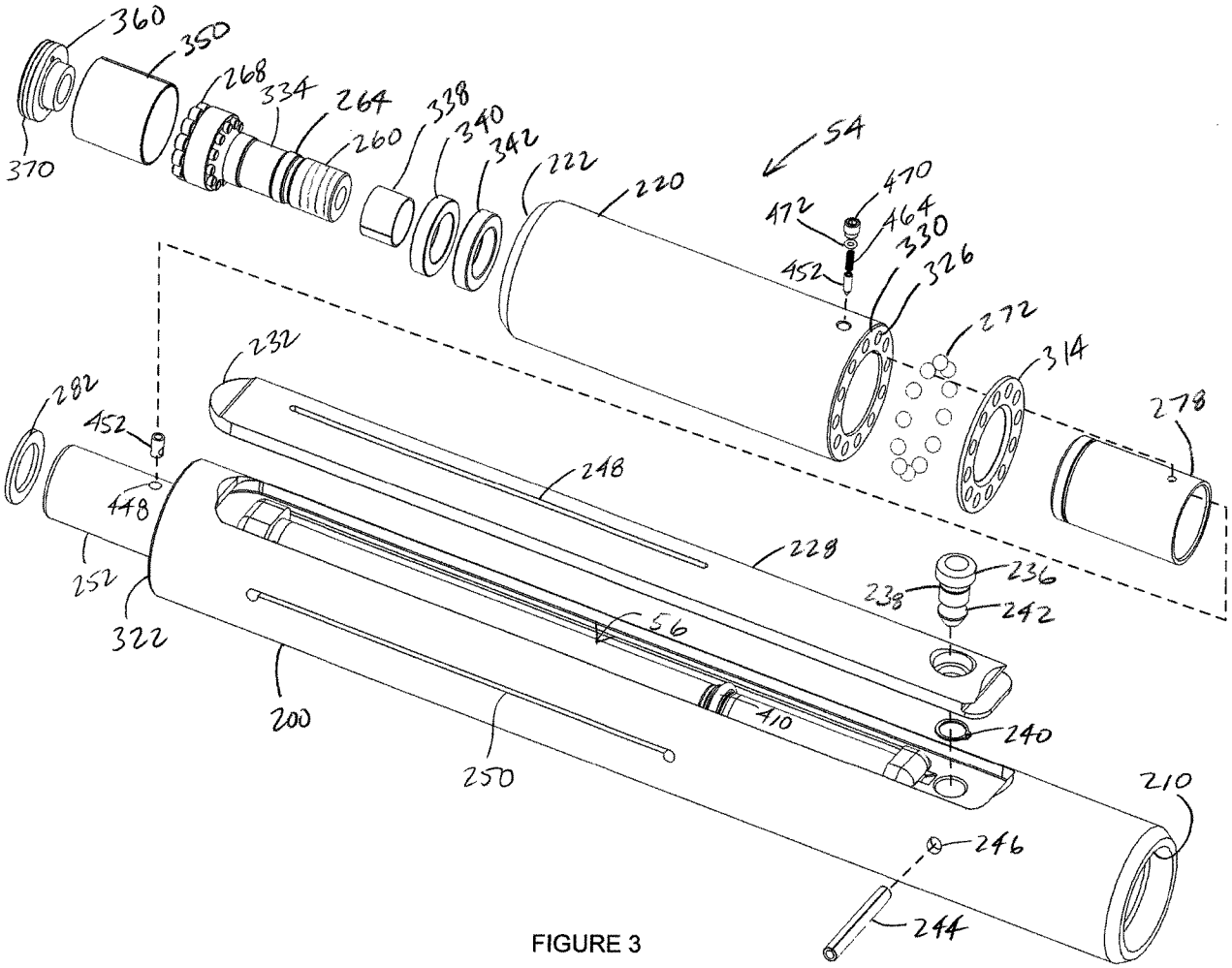
FIG. 3 is a diagrammatic, exploded perspective view of the embodiment of the inground housing of FIG. 2.
Figure 4:
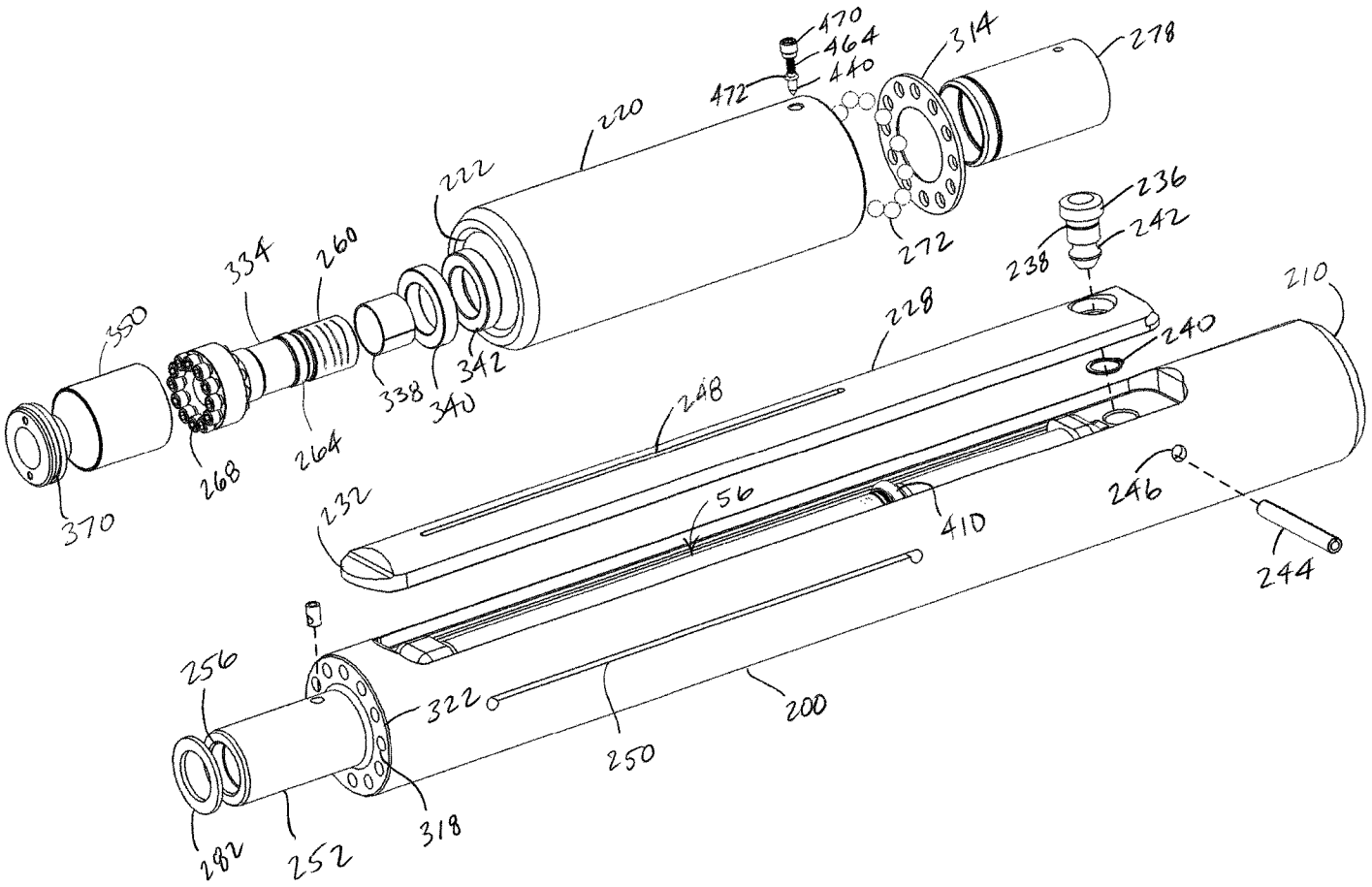
FIG. 4 is another diagrammatic, exploded perspective view of the embodiment of the inground housing of FIG. 2.

Attention is now directed to FIGS. 3 and 4, in conjunction with FIG. 2. FIG. 3 is a diagrammatic exploded view, in perspective, of inground housing 54 as seen from box fitting 210 end, while FIG. 4 is a diagrammatic exploded view, in perspective, as seen from box fitting 222 end. It should be appreciated that threads have been shown no more than diagrammatically, if at all, on the pin and box fittings of the various figures as well as on other components, but are understood to be present and such threaded connections are well-known. Main housing 200 defines an interior cavity for receiving electronics package 56. A lid 228 is receivable by the main housing by first inserting a tab 232 and then securing the lid using a pin 236. Initially, the pin can be secured to the lid by inserting the pin into the lid and through a retaining clip 240. The latter is receivable within an annular groove 238 such that the pin can be retained with the lid when the lid is removed from main housing 200. Pin 236 defines a reduced diameter annular channel 242 such that a roll pin 244 can be inserted into an opening 246 defined by the main housing and received in annular channel 242 to retain lid 228 in an installed position, as will be seen in a subsequent figure. Once the lid is installed, electronics package 56 is captured between the housing and the lid. A slot 248 can be defined by the lid with additional slots 250 being defined by main housing 200 for purposes of allowing emanation of locating signal 66 of FIG. 1 as well as to allow a pressure sensor of the electronics package to be subject to pressure in the annular region surrounding a borehole.

Still referring to FIGS. 3 and 4, a main housing extension 252 extends from and can be integrally formed with main housing 200. As seen in FIG. 4, the main housing extension defines an entrance opening 256. An internal thread of the main housing extension is configured to receive a threaded end portion 260 of a main assembly bolt 264. When assembled, a plurality of preload bolts 268 can be used to apply a preload compression force to a plurality of electrically insulative electrical isolators 272 in a manner that will be described below. In other embodiments, a shaft can be used in place of main assembly bolt. A free end of this shaft can be threaded to receive a nut in place of preload bolts 268. The nut can be adjusted to apply the preload. Such a shaft can be integrally formed with main housing 200 or configured to threadingly engage main housing extension 252. In the present embodiment, the electrical isolators are ceramic members. While the ceramic members can be of any suitable form, spherical ceramic isolators have been found to be useful. Other suitable shapes will be discussed at an appropriate point hereinafter. The main housing, intermediate housing, lid, main assembly bolt and other suitable components can generally formed from suitable high strength materials such as, for example, 4340, 4140, 4142 as well as 15-15HS or Monel K500 (wherein the latter two are non-magnetic high strength alloys), since these components are subjected to the potentially hostile downhole environment as well as relatively extreme force loads during an inground operation. Material selection can be based, at least in part, on the performance characteristics of typical drill pipe sections. A spacer cylinder 278 is receivable on main housing extension 252 with an insulator disk 282 abutted against the end surface of the main housing extension.

Figure 5:
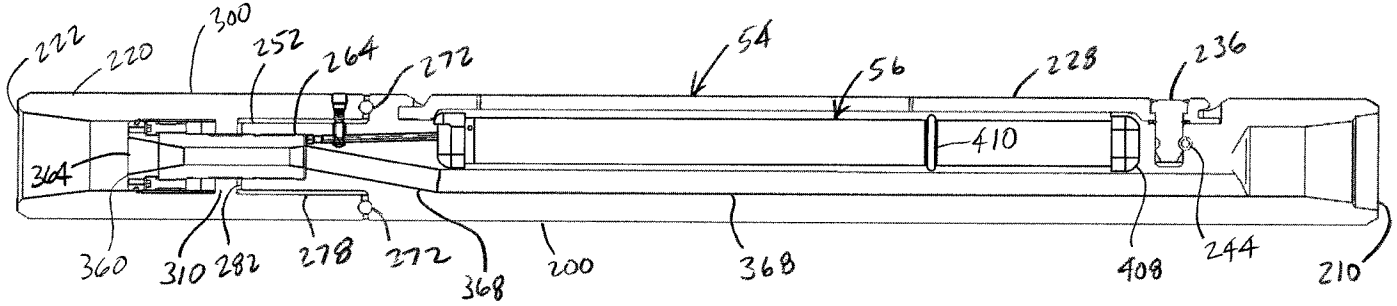
FIG. 5 is a diagrammatic partially cutaway assembled view, in elevation, of the embodiment of the inground isolator housing of FIG. 2, shown here to illustrate the components of the housing in an assembled relationship.
Figure 6:
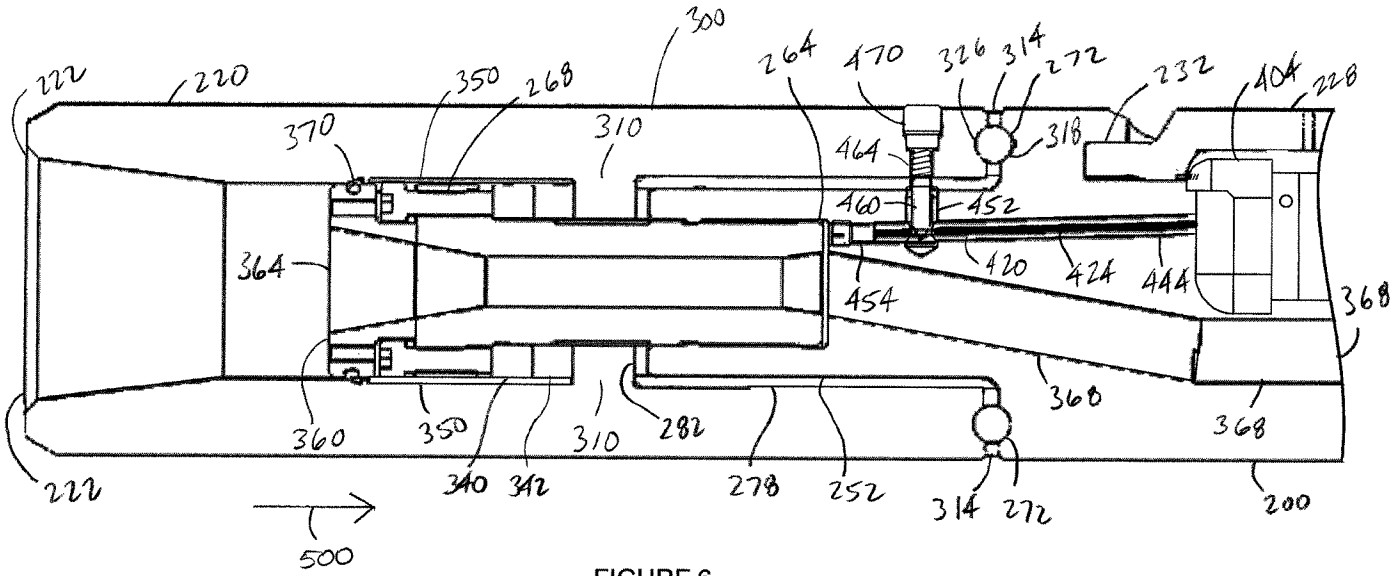
FIG. 6 is diagrammatic further enlarged cutaway view, in elevation, of a portion of the embodiment of the isolator of FIG. 2, shown here to illustrate further details of its structure.

Attention is now directed to FIGS. 5 and 6 in conjunction with FIGS. 2-4. FIG. 5 is a diagrammatic partially cutaway assembled view, in elevation, of inground housing 54 supporting electronics package 56 while FIG. 6 is a further enlarged diagrammatic partially cutaway assembled view, in elevation, of a portion of one end 300 of the inground housing. As seen in FIGS. 5 and 6, intermediate housing 220 includes an internal flange 310. When the intermediate housing is installed onto extension 252, insulator disk 282 is captured between one surface of internal flange 310 and an end face of the extension while spacer cylinder 278 is disposed between the sidewall of the extension and an interior sidewall of the intermediate housing. At the same time, an annular spacer disk 314 defines openings that are configured to receive a major diameter of isolators 272 such that each isolator is partially received in a semi-spherical (i.e., a portion of a spherical shape) recess 318 (FIG. 4) defined by an end face 322 of main housing 200 and partially received in a semi-spherical recess 326 (FIG. 3) defined by an end face 330 of intermediate housing 220. Main assembly bolt 264 defines a channel 334 (FIGS. 3 and 4) that receives a split insulator sleeve 338. With the latter in place, the main assembly bolt is installed through first and second insulator or thrust rings 340 and 342, respectively, to threadingly engage extension 252. An outer surface of split insulator sleeve 338 confronts an inner surface of flange 310. An outer insulator sleeve 350 is received to surround a head of the main assembly bolt and extends to flange 310 outward from insulator rings 340 and 342. With main assembly bolt 264 installed, preload bolts 268 can be torqued to apply a compressive preload to isolators 272. The preload force can be based on a number of factors including, but not limited to the type of material from which the isolators are formed, the shape of the isolators, the anticipated loads to be encountered during an inground operation. The preload force should be sufficiently high such that drill rig pull force, drill string bending or any combination thereof will not result in dislodging one or more isolators. After applying the preload force, an input funnel 360 can be inserted into fitting 222 such that a through opening 364 leads through the assembly to a through passage 368 that is defined by main housing 200 and leads to opposing box fitting 210 such that drilling fluid can pass through the assembly to be emitted from drill head 50 as jets 52 (FIG. 1) or some other inground tool which requires a fluid supply. The input funnel can be maintained in an installed position, for example, by an O-ring 370 that is received in a peripheral groove of the input funnel and a cooperating groove that is defined by intermediate housing 220. The various electrically insulating components including split insulating sleeve 338, first thrust ring 340, second insulator ring 342, spacer cylinder 278, insulator disk 282, annular spacer disk 314, outer insulator sleeve 350, and input funnel 360 can be formed from any suitable materials including but not limited to those listed immediately hereinafter. The first and second thrust rings can be formed, for example, from TTZ (Tetragonally Toughened Zirconia). Each of spacer cylinder 278, insulator disk 282, annular spacer disk 314 and outer insulator sleeve 350 can be formed, for example, from PVC (Poly Vinyl Chloride), PEEK (Polyether Ether Ketone) or acetal. Input funnel 360 can be formed, for example, from UHMW (Ultra High Molecular Weight polyethylene) or rubber.

Figure 7:
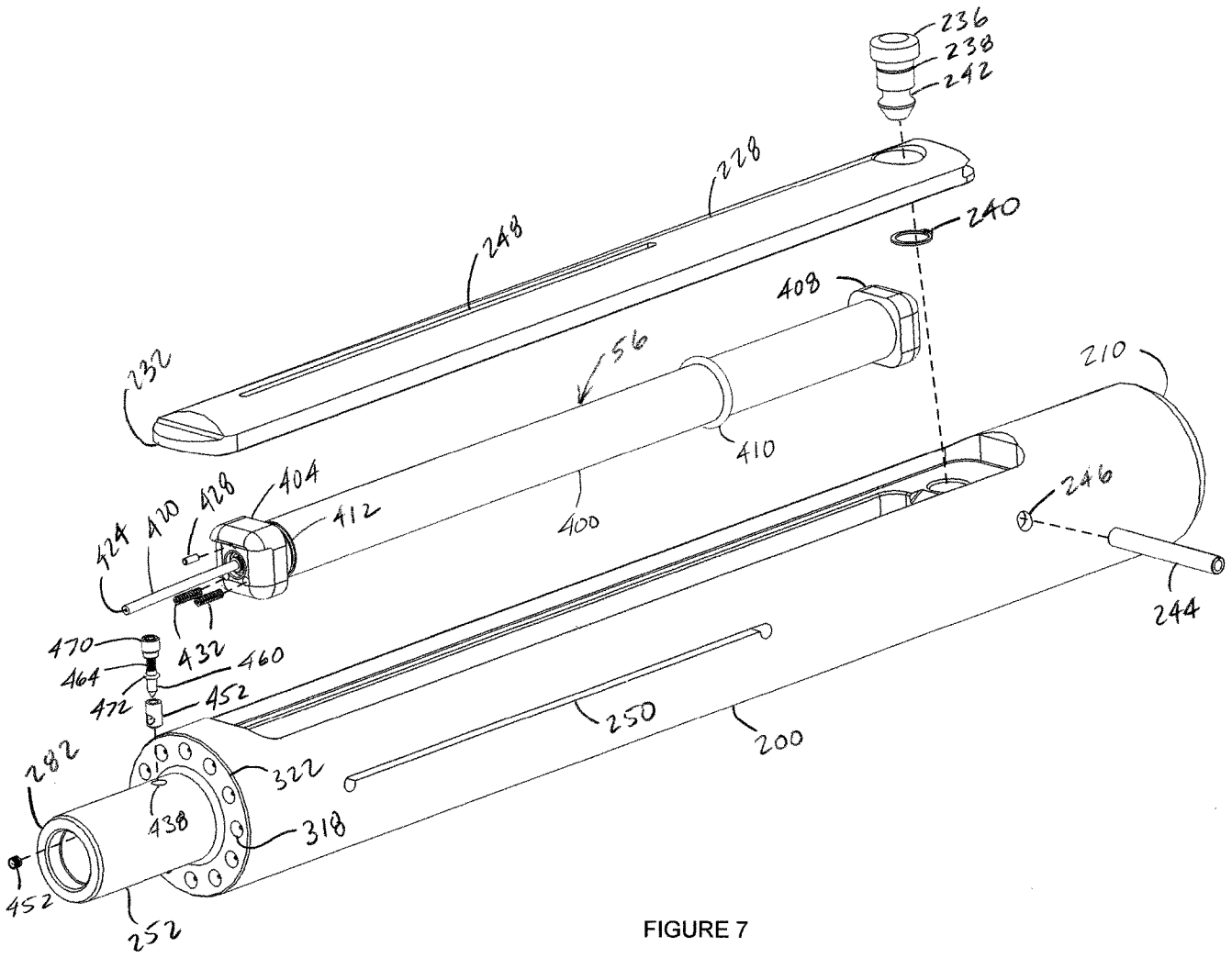
FIG. 7 is a diagrammatic exploded view, in perspective, showing further details of the embodiment of the inground housing of FIG. 2 as well as an associated electronics package.

With reference to FIGS. 5-7, attention is now directed to details with regard to the installation of electronics package 56 and the manner in which electrical connections are formed between the electronics package and the housing components. FIG. 7 is a diagrammatic exploded view, in perspective, showing main housing 200, electronics package 56, associated electrical connection components and features. As best seen in FIG. 7, the electronics package can include an elongated cylindrical body 400 having first and second tail bumpers 404 and 408 arranged at each end of first and second ends, respectively, of the body. An O-ring 410 can support the body at an intermediate position. The first end of body 400 can support an electrically conductive end cap 412 that is in electrical communication, for example, with a negative power lead/terminal that serves internal circuitry of the package. It is noted that this end cap can serve as one terminus of electrical connection 100*b* of FIG. 1. A cable 420 extends from first tail bumper 404 and includes an electrically insulative jacket surrounding an electrical conductor 424 for carrying information bidirectionally between the electronics package and the drill rig. It is noted that electrical conductor 424 can serve in forming electrical connection 100*a* of FIG. 1. An indexing dowel 428, for example, can be press-fitted to hold tail bumper 404 in position on end cap 412. Contact springs 432 can be received in apertures that are defined by tail bumper 404 to electrically engage end cap 412. The free ends of the contact springs form a local electrical connection to main enclosure 200, thereby completing electrical connection 100*b* of FIG. 1 upon final installation of the electronics package. Prior to such final installation, however, cable 420 is extended through a passage 444 (FIG. 6) that intersects an aperture 448 (FIG. 3) such that the cable extends through a contact insulator 452 with the electronics package in an installed position. It is noted that passage 444 can be terminated by a plug 454 that can be threadingly received by extension 252. A piercing pin 460, biasing spring 464, cap 470 and O-ring 472 are installed via aligned openings that are defined by intermediate housing 220 and spacer cylinder 278 such that the piercing pin contacts cable 420 within contact insulator 452. Cap 470 can threadingly engage intermediate housing 220 whereby tightening the cap causes the electrically conductive piercing pin to pierce the jacket of the cable and form an electrical connection with conductor 424. Spring 464 is in electrical contact with the piercing pin which is itself in electrical contact with cap 470. Because the latter is in electrical contact with intermediate housing 220, an electrical connection is formed to complete electrical connection 100*a* of FIG. 1 between the intermediate housing and conductor 424 such that an electrical signal, carried by the cable, can be coupled to the intermediate housing and thereby to the electrically conductive drill string leading to the drill rig or, oppositely, a signal from the drill rig on the drill string can be coupled to the cable and thereby the electronics package.

Having described the structure of inground housing 54 in detail above, attention is now directed to details with regard to aspects of its operation. During installation, preload bolts 268 can be torqued to a significant value such as, for example, 2500 foot-pounds to apply compressive force to isolators 272 such that a compressive preload is applied to all of the isolators. In other words, the compressive preload attempts to stretch main assembly bolt 264 responsive to compressing the isolators between main housing 200 and intermediate housing 220. The amount of compressive force, on an individual one of the electrical isolators can be based on the amount of retraction and/or thrust (push and/or pull) force that any given drill rig is capable of generating. The present embodiment is capable of withstanding 100,000 pounds of push or retraction force with 12,000 pound-feet of torque applied by the drill rig.

Referring to FIG. 6, push force 500 is illustrated by an arrow. When intermediate housing 220 receives such a push/extension force from the uphole portion of the drill string, the intermediate housing transfers the push force to main housing 200 directly through isolators 272. The isolators are subjected only to an increase in compression, above the preload compression, responsive to the push force. In contrast, when the intermediate housing receives a pull/retraction force from the drill string, internal flange 310 moves toward the head of main assembly bolt 264 to apply the retraction force to the head of the main assembly bolt via insulator rings 340 and 342 as well as preload bolts 268. The main assembly bolt, in turn, applies the retraction force directly to extension 252 of main housing 200 such that the main housing is pulled responsive to the retraction force. Again, the isolators are subjected only to an increase in compression responsive to the retraction force.

It should be appreciated that isolators 272 can be subjected to very high compressive loading during an inground operation, however, the isolators are subject to no more than compression responsive to the drill rig extending and/or retracting the drill string. Flexural loading is applied to the isolators only in response to rotation of the drill string. In this regard, however, such flexural loading has been found by Applicants to be significantly lower that the compressive loading. That said, a suitable material is needed in order to endure such compression. Suitable materials can include ceramic materials that are either currently available or yet to be developed. By way of non-limiting example, suitable materials include silicon nitride and transformation toughened zirconia. Empirical testing performed by Applicants has demonstrated that an arrangement of only three spherical silicon nitride electrical isolators can be capable of withstanding three times the rated torque of a typical drill pipe section. In other embodiments, isolators 272 can include peripheral outlines that can be other than spherical. In such embodiments, the recesses that capture the electrical isolators can include a complementary shape. By way of non-limiting example, other suitable shapes can comprise a wide range of geometric shapes including but not limited to elongated such as cylindrical and ortho-rectangular. Further, the layout and/or overall number of the electrical isolators can be changed in any suitable manner. With regard to layout, for example, concentric rings of electrical isolators can be provided.

Figure 8:
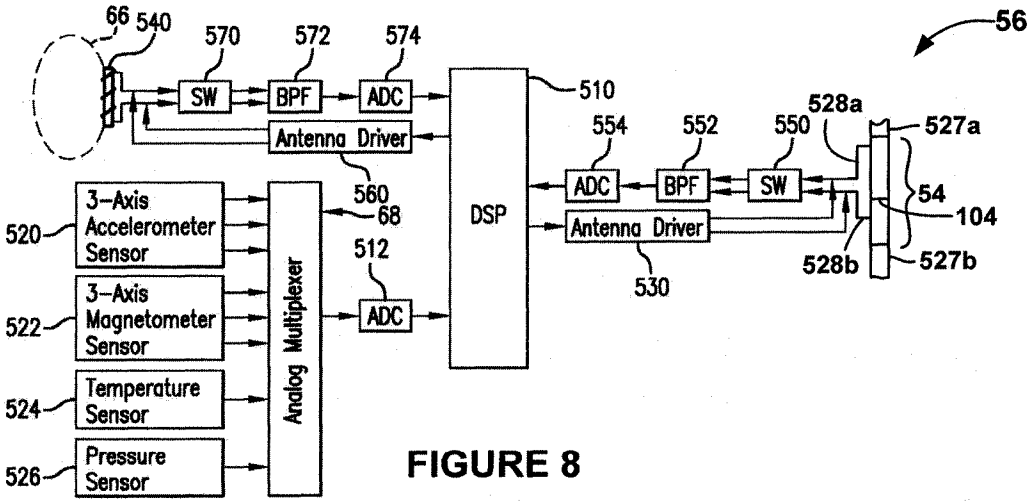
FIG. 8 is a block diagram of an embodiment of a downhole electronics package that is suitable for use with an embodiment of the inground isolator housing of the present disclosure.

FIG. 8 is a block diagram which illustrates an embodiment of electronics package 56 in further detail. The electronics package can include an inground digital signal processor 510 which can facilitate all of the functionality of transceiver 64 of FIG. 1. Sensor section 68 is electrically connected to digital signal processor 510 via an analog to digital converter (ADC) 512. Any suitable combination of sensors can be provided for a given application and can be selected, for example, from an accelerometer 520, a magnetometer 522, a temperature sensor 524 and a pressure sensor 526 which can sense the pressure of drilling fluid prior to being emitted from the drill string and/or within the annular region surrounding the downhole portion of the drill string. Inground housing 54 is diagrammatically shown as forming electrically isolating break 104, separating an uphole portion 527*a* of the drill string from a downhole portion 527*b* of the drill string for use in one or both of a transmit mode, in which data is coupled onto the drill string, and a receive mode in which data is recovered from the drill string. Downhole portion 527*b* can comprise a drill head or any other suitable type of inground tool such as, for example, a reaming tool for use in a pullback operation with a tension monitoring arrangement or a mapping tool. In some cases, the downhole portion can include one or more drill pipe sections or other inground subs between inground housing 54 and the inground tool. The electronics section is connected across the electrically insulating/isolating break formed by the isolator by a first lead 528*a* and a second lead 528*b* which can be referred to collectively by the reference number 528. For the transmit mode, an antenna driver section 530 is used which is electrically connected between inground digital signal processor 510 and leads 528 to directly drive the drill string. Generally, the data that can be coupled into the drill string can be modulated using a frequency that is different from any frequency that is used to drive a dipole antenna 540 that can emit aforedescribed signal 66 (FIG. 1) in order to avoid interference. When antenna driver 530 is off, an On/Off Switcher (SW) 550 can selectively connect leads 528 to a band pass filter (BPF) 552 having a center frequency that corresponds to the center frequency of the data signal that is received from the drill string. BPF 552 is, in turn, connected to an analog to digital converter (ADC) 554 which is itself connected to digital signal processing section 510. Recovery of the modulated data in the digital signal processing section can be readily configured by one having ordinary skill in the art in view of the particular form of modulation that is employed.

Still referring to FIG. 8, dipole antenna 540 can be connected for use in one or both of a transmit mode, in which signal 66 is transmitted into the surrounding earth, and a receive mode in which an electromagnetic signal such as, for example, a signal from an inground tension monitoring tool is received. For the transmit mode, an antenna driver section 560 is used which is electrically connected between inground digital signal processor 510 and dipole antenna 540 to drive the antenna. Again, the frequency of signal 66 will generally be sufficiently different from the frequency of the drill string signal to avoid interference therebetween. When antenna driver 560 is off, an On/Off Switcher (SW) 570 can selectively connect dipole antenna 540 to a band pass filter (BPF) 572 having a center frequency that corresponds to the center frequency of the data signal that is received from the dipole antenna. BPF 572 is, in turn, connected to an analog to digital converter (ADC) 574 which is itself connected to digital signal processing section 510. Transceiver electronics for the digital signal processing section can be readily configured in many suitable embodiments by one having ordinary skill in the art in view of the particular form or forms of modulation employed and in view of this overall disclosure. The design show in FIG. 8 can be modified in any suitable manner in view of the teachings that have been brought to light herein.

Referring to FIGS. 1 and 9, the latter is a block diagram of components that can make up an embodiment of an aboveground transceiver arrangement, generally indicated by the reference number 600, that is coupled to drill string 16. An aboveground current transformer 602 is positioned, for example, on drill rig 14 for coupling and/or recovering signals to and/or from drill string 16. Current transformer 602 can be electrically connected for use in one or both of a transmit mode, in which data is modulated onto the drill string, and a receive mode in which modulated data is recovered from the drill string. A transceiver electronics package 606 is connected to the current transformer and can be powered by the drill rig. For the transmit mode, an antenna driver section 610 is used which is electrically connected between an aboveground digital signal processor 620 and current transformer 602 to drive the current transformer. The data that can be coupled into the drill string can be modulated using a frequency that is different from the frequency that is used to drive dipole antenna 540 in inground housing 54 (FIG. 1) in order to avoid interference as well as being different from the frequency at which inground housing 54 (FIG. 8) drives a signal onto the inground end of the drill string. When antenna driver 610 is off, an On/Off Switcher (SW) 620 can selectively connect current transformer 602 to a band pass filter (BPF) 622 having a center frequency that corresponds to the center frequency of the data signal that is received from the drill string. BPF 622 is, in turn, connected to an analog to digital converter (ADC) 630 which is itself connected to digital signal processing section 632. It should be appreciated that digital signal processing section 632 and related components can form part of processing arrangement 46 (shown using a dashed line) of the drill rig or be connected thereto on a suitable interface 634. Transceiver 606 can send commands to the inground tool for a variety of purposes such as, for example, to control transmission power, select a modulation frequency, change data format (e.g., lower the baud rate to increase decoding range) and the like. Transceiver electronics for the digital signal processing section can be readily configured in many suitable embodiments by one having ordinary skill in the art in view of the particular form or forms of modulation employed and in view of this overall disclosure.

Still referring to FIGS. 1 and 9, in a repeater embodiment, another inground housing arrangement 640 (shown within a dashed box), can replace current transformer 602 along with another instance of inground housing 54. Arrangement 640 can include any suitable embodiment of the inground housing. The latter, in this arrangement, supports transceiver 606 and is inserted as a unit into one of the joints of the drill string to serve in the manner of a repeater, by way of example, 1000 feet from the inground tool. Thus, a section 527*a*' of the drill string can connect the repeater to the drill rig while a section 527*b*' of the drill string serves as an intermediate section of the drill string leading to inground housing 54 at the inground tool. The repeater unit can be inserted, for example, in the joint formed between drill pipe sections 1 and 2 in FIG. 1. The inground housing, for use in a repeater application, can include a box fitting at one end and a pin fitting at an opposing end. Of course, one of ordinary skill in the art will recognize that box to pin fitting adapters are well known and readily available. In order to avoid signal interference and by way of non-limiting example, a repeater can pick up the signal originating from the inground tool or another repeater at one carrier frequency and the repeater electronics can retransmit the signal up the drill string at a different carrier frequency in order to render the signals distinguishable from one another. As another example, suitable modulation can be used to make the signals distinguishable. Thus, the repeater electronics package can be housed in any suitable manner in electrical communication with the signal coupling arrangement of the isolator for producing a repeater signal based on the received data signal, but which is distinguishable from the received data signal.

Attention is now directed to FIGS. 10 through 12. The former is a diagrammatic perspective, assembled view illustrating another embodiment of the inground housing of the present disclosure, generally indicated by the reference number 54'. FIG. 11 is a diagrammatic partially exploded view of housing 54'. To the extent that housing 54' shares features with aforedescribed housing 54, descriptions of like features and components may not be repeated for purposes of brevity. FIG. 12 is a diagrammatic view, in perspective, that is taken from below a modified lid 228'. The latter continues to define slot 244, however, the lid has been outwardly widened at least generally in the region of slot 244. In this way, opposing extensions 700 are formed, each of which includes a lengthwise edge 706 as part of a peripheral edge configuration of the lid. Each extension defines a surface 708. The lid defines a lid cavity 710 for at least partially receiving electronics package 56 when the lid is installed. At the same time, a modified main housing 200' defines a support groove 712 that can be formed within a floor 714 such that the support groove receives electronics package 56. At the periphery of floor 714, an outer edge 720 is formed at an intersection with the cylindrical configuration of main body 200'. When lid 228' is installed on main housing 200', opposing slots 730 (one of which is visible) are defined between each lid surface 708 and floor 714 in a confronting relationship such that each lengthwise edge 706 is in a confronting relationship with one of outer edges 720 at an entrance of each slot 730. Slots 730 serve in the same manner as previously described slots 250 for purposes of enhancing the emanation of the locating signal by limiting eddy currents which could otherwise flow between the lid and main body. Slots 730 can be of any suitable width including just wide enough to prevent the flow of eddy currents. While slots 730 are shown as being linear or straight in configuration, it should be appreciated that this is not a requirement. In some embodiments, the slot ends can be further extended about at least a portion of the curved confronting relationship between main housing and lid. Applicants have recognized, in this regard, that cutting slots or grooves in thick, high strength steel is nontrivial and can contribute significantly to the overall cost in producing an inground housing.

Referring to FIGS. 11 and 12, a modified pin 236' can be fixedly attached to lid 228', for example, by welding. Pin 236 can be formed in any suitable manner including being integrally formed with the lid. In the present embodiment, pin 236' defines a through hole 736 for receiving roll pin 244 upon installing the lid on the housing. Once the lid is installed, electronics package 56 is captured between the housing and the lid.

The foregoing descriptions are not intended as being limiting with respect to the specific forms and/or features of inground housings that have been utilized for purposes of forming an electrically isolating break or gap in the drill string. In this regard, any suitable modifications for purposes of forming an electrically isolating drill string gap are considered to be within the scope of the present disclosure so long as the teachings that have been brought to light herein are being practiced. Accordingly, embodiments of an inground housing have been provided which, in any of its various forms, facilitates communication using the drill string as an electrical conductor while maintaining robust mechanical performance characteristics that measure up to or can even exceed the performance characteristics of the drill rods themselves which make up the drill string. It is submitted that such an inground housing, associated components and methods have not been seen heretofore. The present disclosure is submitted to sweep aside the limitations of prior art approaches that attempt to provide an electrically isolating break in the drill string by introducing what is, in effect, a weakened annular connection that is formed using an electrical insulator but which is nevertheless subject to full operational loading or other prior art approaches that attempt to use relatively thin layers of insulating/dielectric material that are subject to compromise by being worn through.

The foregoing description of the invention has been presented for purposes of illustration and description. For example, in another embodiment, inground electronics package and the inground housing can be configured to receive a locating signal rather than transmitting a locating signal. In such an embodiment, the locating signal can be a magnetic dipole field that is emanated by a permanent magnet being rotated about a rotational axis that is transverse to an axis that extends between the north and south poles of the magnet. The rotating magnet field can be received by magnetometers serving as sensors that form part of the electronics package. For purposes of receiving a magnetic signal, the inground housing of the present disclosure and associated components can be formed from non-magnetic materials. Further, it may not be necessary to form slots in the housing and housing lid for this embodiment. Such a system is described in detail, for example, in U.S. Pat. No. 7,775,301 which is commonly owned with the present application and incorporated herein by reference in its entirety. Accordingly, the present disclosure is not intended to be exhaustive or to limit the invention to the precise form or forms disclosed, and other embodiments, modifications and variations may be possible in light of the above teachings wherein those of skill in the art will recognize certain modifications, permutations, additions and sub-combinations thereof.

What is claimed is:

1. A housing arrangement for use as part of an inground tool for receiving a transmitter to transmit a locating signal from the inground tool, said housing arrangement comprising:

a main housing for supporting the transmitter in an operating position while emanating the locating signal; and a lid configured for removable installation on the housing such that at least a portion of the main housing and a portion of the lid are disposed in a confronting relationship to cooperatively define at least one elongated slot leading from an exterior of the housing arrangement to the transmitter with the transmitter received in the housing.

2. The housing arrangement of claim 1 wherein the main housing and lid cooperate to define an opposing pair of elongated slots each of which leads from the exterior of the housing to the transmitter with the transmitter received in the housing.

3. The housing arrangement of claim 2 wherein said lid defines a lid slot between the opposing pair of elongated slots.

4. The housing arrangement of claim 1 wherein the main housing includes an elongation axis and said slot is parallel with the elongation axis.

5. A housing for use as part of an inground tool for supporting an electronics package having an output cable for carrying an output signal, said housing comprising:

a housing body that is electrically conductive and defines a cavity for receiving said electronics package such that the electronics package forms a first electrical connection to the housing body; and an intermediate housing that is electrically conductive and which is receivable on one end of the housing body to cooperate with the housing body in a way that forms an electrical isolation gap between the intermediate housing and the housing body, and the intermediate housing forms a second electrical connection with said cable such that the electronics package is electrically bridged across the gap.

* * * * *